United States Patent [19]

Holborow et al.

[11] Patent Number: 4,976,286

[45] Date of Patent: Dec. 11, 1990

[54] FOUR-WAY SLIDE VALVE

[75] Inventors: Peter Holborow, Califon; Gary Kramer, Lincoln Park, both of N.J.

[73] Assignee: Automatic Switch Company, Florham Park, N.J.

[21] Appl. No.: 452,918

[22] Filed: Dec. 14, 1989

[51] Int. Cl.[5] ..... F16K 31/40; F16K 31/363

[52] U.S. Cl. ..... 137/625.43

[58] Field of Search ..... 137/625.43, 625.29

[56] References Cited

U.S. PATENT DOCUMENTS

| | | | |
|---|---|---|---|
| 3,894,561 | 7/1975 | Thornbery | 137/625.29 |
| 3,985,154 | 10/1976 | Hargraves | 137/625.29 |
| 4,221,237 | 9/1980 | Nelson | 137/625.29 |
| 4,248,058 | 2/1981 | Bauer et al. | 137/625.43 X |

*Primary Examiner*—Arnold Rosenthal

*Attorney, Agent, or Firm*—Alan H. Levine

[57] ABSTRACT

A four-way slide valve including an elongated valve body having an inlet port, an outlet port, and two working ports. A slide assembly within the body is movable longitudinally to alternatively interconnect the outlet port with one or the other of the working ports. The slide assembly carries two longitudinally spaced-apart first and second pistons which define first and second chambers between the pistons and their respective ends of the valve body. Passageways within the slide assembly provide communication between the first chamber and the outlet port, and a control device, such as a pilot valve within the valve body, selectively provides communication between the second chamber and either the inlet port or the outlet port, so as to cause the slide member to move to one of its extreme positions or the other. The first piston is smaller than the second piston, the first chamber is in constant communication with the outlet port, and the region between the pistons is in constant communication with the inlet port. The movable armature of a solenoid actuator acts directly upon the pilot valve within the slide valve body, the movement of the armature in one direction causing movement of the slide assembly in the opposite direction. A slide member forming part of the slide assembly, slides upon a flow plate which contains the outlet and working ports, the face of the slide member opposite the flow plate being in communication with the outlet port.

17 Claims, 7 Drawing Sheets

FOUR-WAY SLIDE VALVE

This invention relates to four-way slide valves of the type including an elongated valve body and a slide assembly movable longitudinally within the valve body between two extreme positions. In one extreme position of the slide assembly, the high pressure inlet port of the valve communicates with one of the two working ports of the valve, and the other working port communicates with the low pressure outlet port of the valve. In the other extreme position of the slide assembly, the connections are reversed, and the one working port communicates with the outlet port and the other working port communicates with the inlet port.

Typically in these valves, the slide assembly includes two longitudinally spaced apart pistons slidably engaging the interior of the valve body, each of the pistons defining a chamber between itself and its respective end of the valve body. Between the pistons is a slide member engaging a flow plate within the valve body, the flow plate containing the outlet port and both working ports. The slide member includes a cavity which provides communication between the outlet port and each of the working ports when the slide assembly is in one or the other of its extreme positions.

The region between the two pistons is in constant communication with the inlet port. The position of the slide assembly is controlled by a pilot valve located exterior to the slide valve body. Capillary tubing connects the pilot valve with the low pressure outlet port, as well as with each of the chambers at the ends of the valve body. Thus, the pilot valve alternatively connects one or the other of the chambers to the low pressure region and hence the slide assembly moves in the direction of the chamber connected to low pressure. A small bleed hole in each piston permits a low rate of flow of high pressure fluid from the region between the pistons into each of the chambers at the ends of the valve body.

Four-way valves of this type find utility in many different types of installations. One application involves use as a reversing valve in a heat pump system. In such an arrangement, the inlet and outlet ports of the slide valve are connected to the outlet and inlet ports, respectively, of a compressor, and the two working ports are connected in series with an inside coil and an outside coil. When the slide valve connects the inlet port, through one of the working ports, to the inside coil, and connects the outside coil, through the other working port, with the outlet port, the inside coil acts as a condenser and the outside coil acts as an evaporator, so that the heat pump system serves a heating function. In the other extreme position of the slide valve, the inlet port is connected, through the other of the two working ports, to the outside coil, and the inside coil is connected, through the first of the working ports, to the outlet port, so that the inside coil acts as an evaporator and the outside coil acts as a condensor, whereby the heat pump system serves a cooling function.

A number of problems are presented by the conventional four-way slide valve of the type described above. The presence of external capillary tubing between the pilot valve and the slide valve body increases the cost and complication of such valves. In addition, the exposed capillary tubing is subject to damage while the valve is being installed or even after it is in place.

In addition, the slide member is constantly exposed to the high pressure fluid between the pistons, and this high pressure fluid presses the slide member against the flow plate upon which the slide member slides. This produces a high frictional force between the slide member and the flow plate, leading to excessive wear and shortened life of the slide valve.

It is an object of the present invention to provide a four-way slide valve, of the general type described above, which is more reliable, less subject to damage, and has a longer useful life than conventional valves of this type.

It is another object of the invention to provide such a valve which completely eliminates the need for external tubing between the pilot valve and the slide valve body. According to the present invention, the pilot valve and passageways for interconnecting the chambers at the ends of the slide valve body with the slide valve ports are all located within the slide valve body.

It is a further object of the present invention to provide a four-way slide valve including a solenoid actuator having an armature which acts directly upon the pilot valve located within the slide valve body. Moreover, an important object of the invention is the provision of such an actuator wherein the solenoid armature has a relatively short stroke but nevertheless is capable of controlling the slide assembly having a much longer stroke.

It is an additional object of the invention to provide such a slide valve wherein the fluid pressure which tends to press the slide member against the flow plate is considerably reduced, so as to reduce the friction between the slide member and the flow plate and thereby reduce the wear caused by relative movement between those parts.

Additional objects and features of the present invention will be apparent from the following description, in which reference is made to the accompanying drawings.

Figure 1:
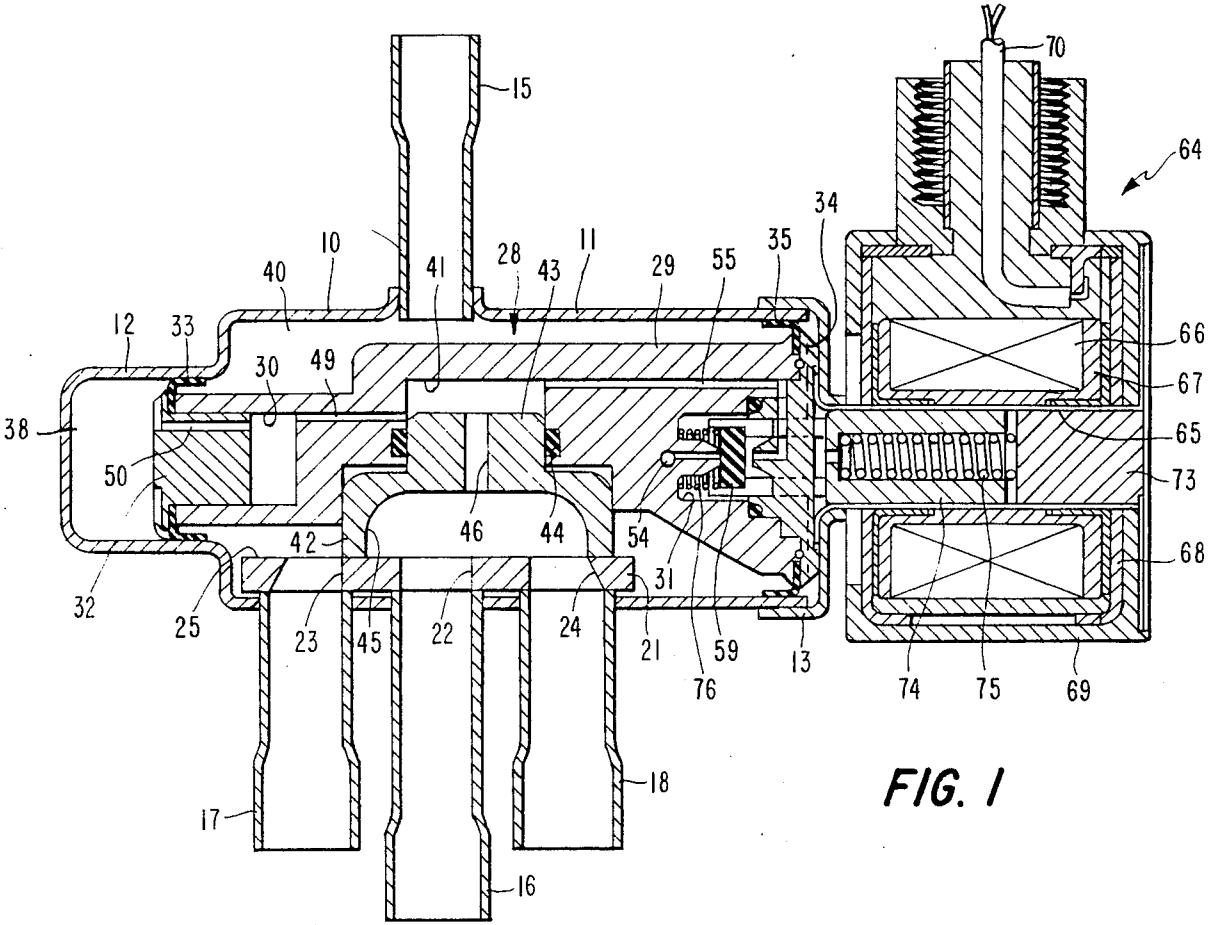
FIG. 1 is an axial, cross-sectional view of a four-way slide valve, according to the present invention, the actuator for the pilot valve being deenergized.

The four-way slide valve chosen to illustrate the present invention, and shown in FIGS. 1–4, includes an elongated valve body 10 having a relatively large diameter portion 11 and a smaller diameter portion 12 at one end of the body. At its other end, body 10 carries a bonnet 13 in fluid-tight engagement with the body.

Body 10 is formed with a hole in its side wall accommodating a short tube 15 serving as an inlet port to the valve. Diametrically opposite tube 15, body 10 is formed with three axially aligned holes, the middle one of which accommodates a short tube 16, serving as an outlet port from the valve, and the end ones of which accommodate short tubes 17 and 18, serving as working ports. Each of the tubes 15–18 is secured to the valve body in a fluid-tight manner, such as by brazing.

Within valve body 10 is a flow plate 21 formed with three holes 22, 23, and 24 aligned with the three tubes 16–18 respectively. One face of the flow plate is permanently fixed to the inner ends of these tubes. The opposite face 25 of plate 21 is very flat and smooth for cooperation with the slide member of the slide valve.

Figure 3:
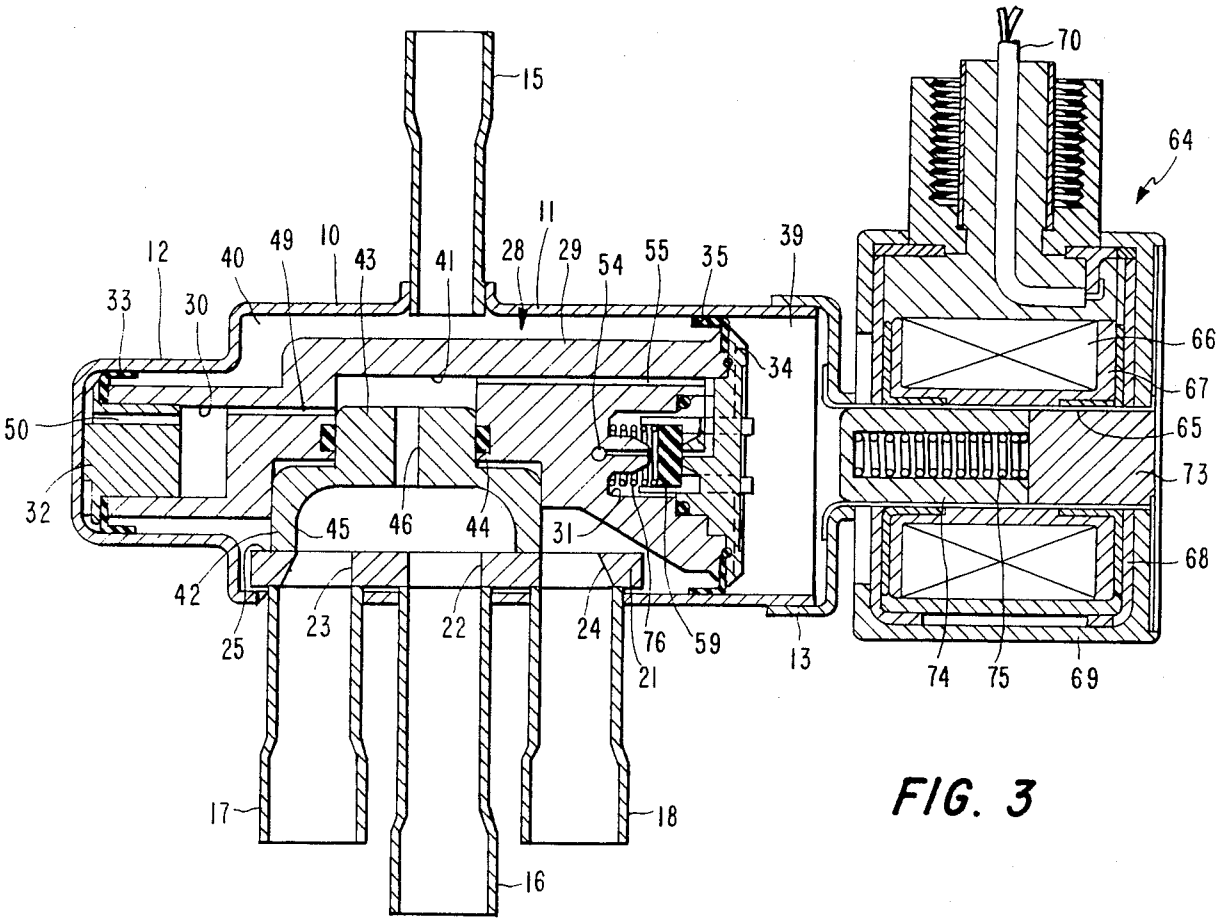
FIG. 3 is a view similar to FIG. 1, the actuator being energized and the slide assembly having shifted in response thereto.

Within valve body 10 is a slide assembly 28 movable longitudinally of the valve body between two extreme positions, shown respectively in FIGS. 1 and 3, closer to one end of the valve body or the other. Slide assembly 28 includes a slide body 29 having an axial bore 30, at one end, and an axial bore 31, having a stepped configuration, at its opposite end. A fitting 32 fixed within bore 30 secures a flexible lip seal 33 to slide body 29. Lip seal 33 slidably engages the inner surface of valve body portion 12 and defines a relatively small diameter piston movable within valve body portion 12. A fitting 34 (see also FIG. 1A), fixed within bore 31, secures a flexible lip seal 35 to slide body 29. Lip seal 35 slidably engages the inner surface of valve body portion 11 and defines a relatively large diameter piston movable within valve body portion 11. It has been found that providing piston 35 with an area twice that of piston 33 admirably serves the purpose of this invention, although other size relationships would work.

Pistons 33 and 35 'divide the interior of valve body 10 into three chambers. A first chamber 38 (FIGS. 1 and 2) is located within the smaller diameter portion 12 of the valve body between piston 33 and the end wall of portion 12. A second chamber 39 is located between piston 35 and bonnet 13 (see FIGS. 3 and 4). Another chamber 40 between the two pistons surrounds slide body 29 and is in constant communication with inlet port 15, and hence is constantly filled with high pressure fluid.

Slide body 29 is formed, between its ends, with a transverse bore 41. A slide member 42 presents a boss 43 slidable within bore 41 in a transverse direction, preferably perpendicular to the axial direction of movement of slide body 29 within valve body 10. A seal 44 provides a fluid-tight relationship between boss 43 and the wall of bore 41.

Figure 4:
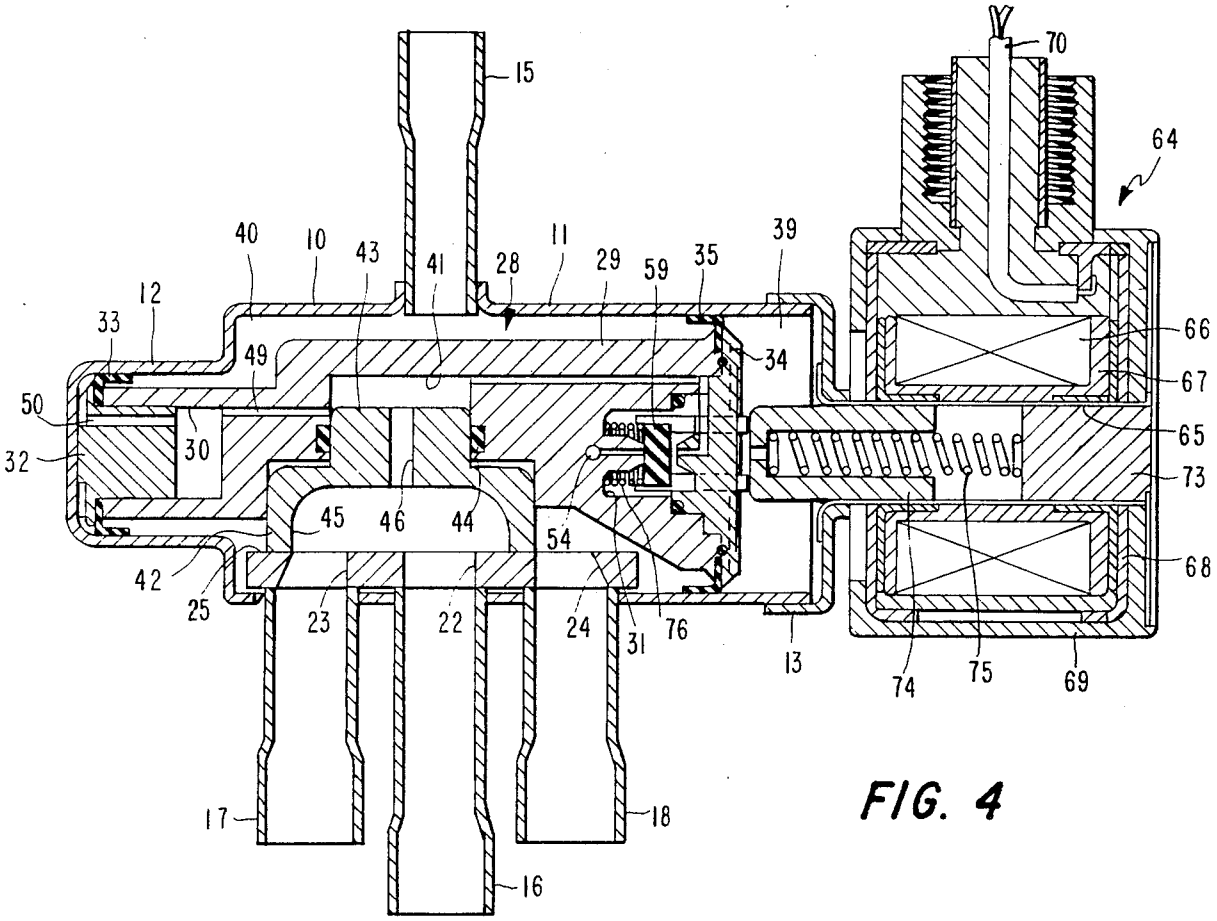
FIG. 4 is a view similar to FIG. 1 after the actuator is deenergized, but before shifting of the slide assembly in response thereto.

The face of slide member 42 opposite boss 43 is slidable on face 25 of flow plate 21. The slide member is formed with a cavity 45 long enough to span, at any one time, just two of the holes 22–24 in flow plate 21. In this way, ports 16 and 18 can communicate through cavity 45 (FIGS. 1 and 2), or alternatively, ports 17 and 16 can communicate through cavity 45 (FIGS. 3 and 4). A through hole 46 in boss 43 provides constant communication between cavity 45 and bore 41.

An internal passageway 49 within slide body 29 provides constant communication between bores 41 and 30, and another internal passageway 50 provides constant communication between bore 30 and chamber 38. As a result, chamber 38 is in constant communication with outlet port 16, through passageway 50, bore 30, passageway 49, bore 41, hole 46, and cavity 45. As a result, the fluid pressure in chamber 38 is always at the relatively low outlet pressure.

The fluid pressure within chamber 39 (FIGS. 3 and 4), and hence the position of slide assembly 28 within body 10, is controlled by a three-way pilot valve. Within bore 31, slide body 29 is formed with a pilot valve seat 52 (see FIG. 1A) spaced from and facing another pilot valve seat 53 presented by fitting 34. An internal passageway 54 within slide body 29 provides communication between an orifice surrounded by valve seat 52 and chamber 40, as a result of which high pressure fluid is always available at the orifice within valve seat 52. Another internal passageway 55 in slide body 29, together with an internal passageway 56 in fitting 34 provides communication between an orifice surrounded by valve seat 53 and bore 41, as a result of which low pressure fluid is always available at the orifice within valve seat 53.

Figure 2:
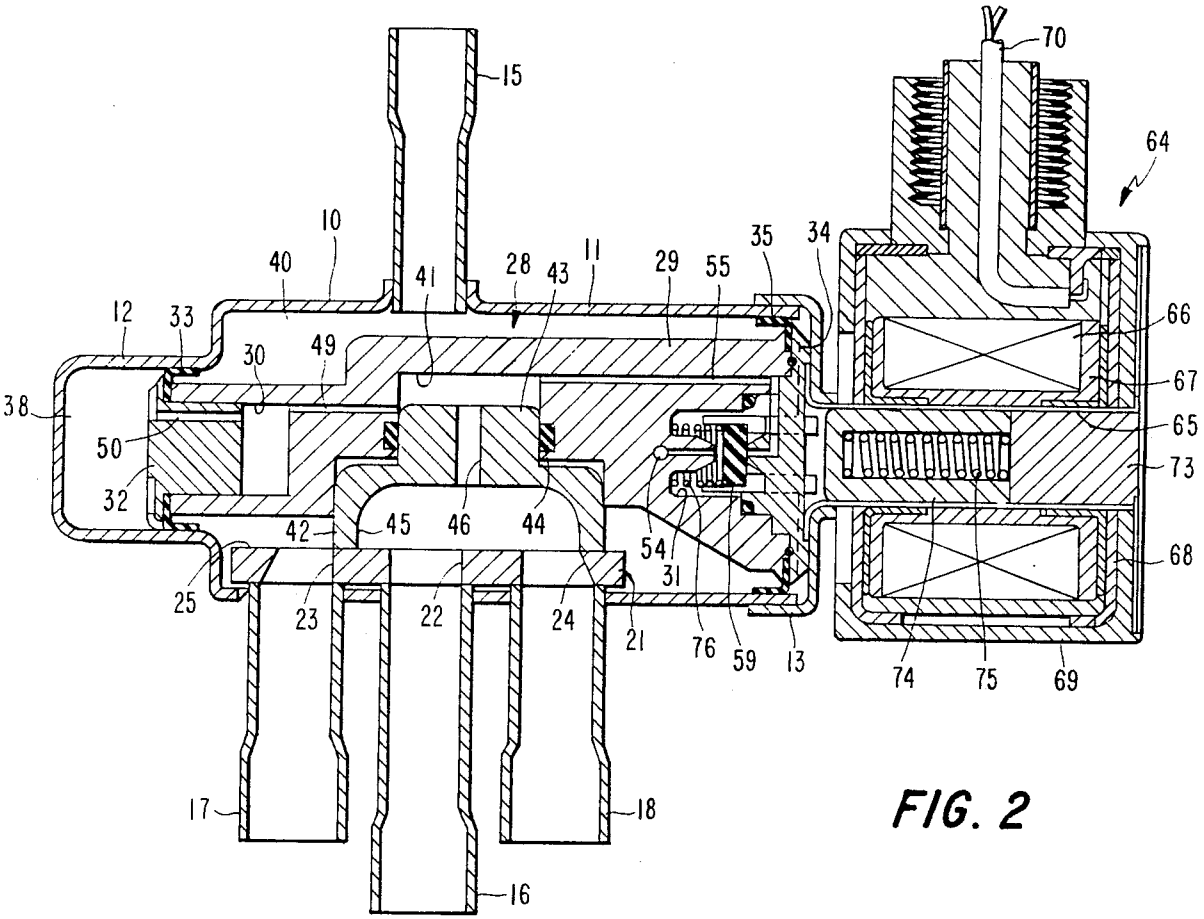
FIG. 2 is a view similar to FIG. 1 after the actuator is energized, but before the slide assembly has shifted.

A pilot valve member 59, of resilient material, is located between the two valve seats 52 and 53, and is alternatively engagable with one seat or the other (compare FIGS. 1 and 2). The valve member 59 is supported by a holder 60 having pins 61 slidable axially within enlarged holes in fitting 34. The holes are large enough to accommodate pins 61 and also to provide constant communication between chamber 39 and the region of bore 31 between the valve seats 52 and 53. Pins 61 serve to transmit movement of the pilot valve actuator to valve member 59.

The pilot valve is operated by a substantially conventional solenoid actuator 64 mounted on bonnet 13. The actuator includes a tube 65 (see also FIG. 1A) extending in the axial direction of slide valve body 10. A solenoid coil 66, wound on a spool 67, surrounds tube 65, the solenoid being surrounded by a yoke 68 of magnetic material, and the assembly being encapsulated in a suitable plastic 69. Suitable wiring 70 is provided for energizing coil 66 with electric power, when desired.

Figure 1A:
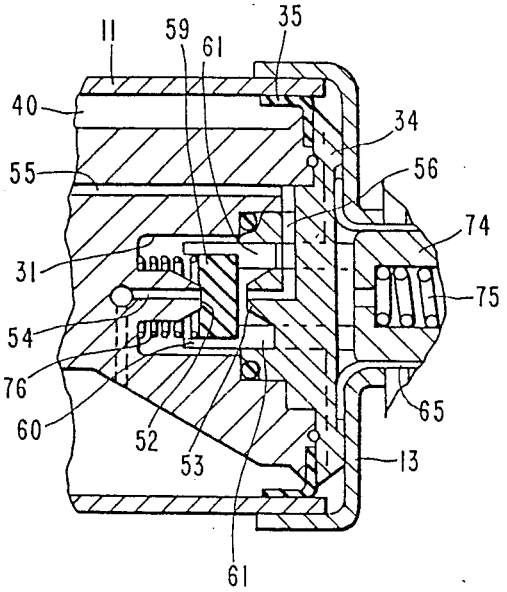
FIG. 1A is a fragmentary view on an enlarged scale showing the pilot valve portion of the slide valve.

A stationary armature, or plugnut, 73 of magnetic material is fixed within the distal end of tube 65. Tube 65 also contains a movable armature 74, of magnetic material, slidable toward and away from plugnut 73. The end of movable armature 74, opposite plugnut 73, can engage the ends of pins 61 passing through fitting 34 (FIGS. 1 and 1A). A relatively strong compression spring 75, located within the hollow interior of armature 74, seats at one end against plugnut 73 and constantly urges armature 74 away from the plugnut. Thus, when armature 74 engages pins 61, spring 75 urges pilot valve member 59 toward seat 52. Another compression spring 76, not as strong as spring 75, constantly urges valve member 59 in the opposite direction, i.e., toward valve seat 53.

When coil 66 is deenergized, spring 75 overpowers spring 76 and, through armature 74 and pins 61, pushes pilot valve member 59 against valve seat 52, thereby closing the orifice through which passageway 54 communicates with bore 31. Thus, no high pressure fluid from chamber 40 can reach bore 31. However, at the same time, valve member 59 is out of engagement with valve seat 53, and bore 31 is at low pressure, since it communicates through passageways 56 and 55, bore 41, hole 46, cavity 45, and hole 22, with outlet port 16. When bore 31 is at low pressure, chamber 39, between piston 35 and bonnet 13, is also at low pressure, since chamber 39 communicates with bore 31, rough the holes which slidably accommodate pins 61. The resulting pressure differential across piston 35, i.e., high pressure in chamber 40 and low pressure in chamber 39, produces a force which moves slide assembly 28 to the position shown in FIG. 1, wherein the slide assembly is in its extreme position closer to, or engaging, the end of valve body 10 defined by bonnet 13. While the pressure differential across piston 33, i.e., high pressure in chamber 40 and low pressure in chamber 38, produces a force in the opposite direction, urging slide assembly away from bonnet 13, the area of piston 33 is small enough, compared to that of piston 35, so that the force on piston 33 is not sufficient to overcome the force on piston 35.

In this position of slide assembly 28 (FIG. 1), slide member 42 provides communication between outlet port 16 and working port 18, whereby the latter is at low pressure. On the other hand, working port 17 communicates with chamber 40, and hence receives high pressure fluid from inlet port 15.

When coil 66 is energized (FIG. 2), movable armature 74 is pulled against plugnut 73, against the force of spring 75. This movement permits spring 76 to shift pilot valve member 59 away from valve seat 52 and into engagement with valve seat 53. As a result, high pressure fluid is now permitted to flow from inlet port 15, through chamber 40 and passageway 54, into bore 31. At the same time, communication between bore 31 and passageway 56 is shut off, whereby bore 31 no longer communicates with outlet port 16. Consequently, high pressure fluid fills bore 31 and flows through the holes accommodating pins 61 into chamber 39.

As chamber 39 fills with high pressure fluid (FIG. 3), the pressures on both sides of piston 35 become equalized and hence the force previously urging slide assembly 28 toward bonnet 13 disappears. The pressure differential across piston 33 remains, however, and the resultant force moves slide assembly 28 toward the smaller end of valve body 10 until the slide assembly reaches its other position, shown in FIG. 3. During this movement, fluid within chamber 38 is expelled through passageway 50, bore 30, passageway 49, bore 41, hole 46, cavity 45, and hole 22 to outlet port 16. As a result of the shift of slide assembly 28 from its extreme position of FIG. 1 to its extreme position of FIG. 3, the condition of working ports 17 and 18 is reversed. Now, working port 17 is connected to outlet port 16 via cavity 45 in slide member 42, and working port 18 is connected to inlet port 15 via chamber 40.

In order to again reverse the slide valve, solenoid coil 66 is deenergized (FIG. 4). This frees spring 75 to move armature 74 into engagement with pins 61 after which further movement shifts pilot valve member 59, against the force of spring 76, away from valve seat 53 and into engagement with valve seat 52. As a result, high pressure fluid in chamber 39 and bore 31 flows to outlet port 16. With the pressure in chamber 39 thus relieved, a pressure differential is reestablished across piston 35 which serves to return slide assembly 28 to its FIG. 1 position.

Several advantages of the slide valve of the present invention may now be appreciated. It will be noted that no tubing external to slide valve body 10 is present for interconnecting pilot valve 59,64 and the slide valve body. Instead, all the required communication between the pilot valve and the slide valve body takes place through bores and passageways within slide assembly 28, specifically, bores 30,31, and 41, and passageways 46, 49, 50, 54, 55, and 56.

In addition, although armature 74 of the pilot valve actuator 64 moves through a very short stroke upon energization of coil 66 (compare FIGS. 1 and 2), slide assembly 28 responds by moving through a relatively long stroke (compare FIGS. 1 and 3). This result is achieved by having armature 74 move in one direction, i.e., rightward in FIG. 1, thereby permitting the high pressure fluid filling chamber 39 to move slide assembly 28 in the opposite direction, i.e., leftward in FIG. 1. In other words, the stroke of slide assembly 28 is in no way limited by the stroke of armature 74. This is advantageous since the shorter the stroke of the movable armature, the lower the power needed to operate the actuator 64.

Another advantage of the short stroke of armature 74, in response to energization of coil 66, involves the fact that spring 75 must be relatively strong so as to produce the relatively long stroke of armature 74 (FIG. 4) when coil 66 is deenergized and slide assembly 28 is to be shifted from its leftwardmost extreme position, shown in FIG. 1. Rightward movement of the slide assembly is produced by fluid pressure acting against the force of spring 75, the latter being compressed as this movement takes place. As a result, the length of the rightward stroke of the armature 74 which must be produced by energization of coil 66 is greatly reduced. Since armature 74 is so close to plugnut 73 (FIG. 1) at the time coil 66 is energized, a relatively small solenoid, and little power, is needed to overcome the force of spring 75 to move armature 74 into engagement with the plugnut (FIG. 2).

A further advantage offered by the valve of this invention involves the reduction of pressure acting to press slide member 42 against flow plate 21. If slide member 42 were made as one piece with slide body 29, as is usually the case, the pressure differential across the slide body, produced by the high pressure fluid in chamber 40 and the low pressure fluid in cavity 45, would press slide member 42 against flow plate 21 with a relatively large force.

However, according to the present invention, boss 43 projecting from slide member 42 cooperates with bore 41 to provide a non-rigid connection between the slide member and slide body 29, whereby slide member 42 has some freedom of movement in a direction toward and away from flow plate 21. Hole 46 in boss 43 brings low pressure from outlet port 16 to the region of bore 41 above boss 43, thereby reducing the force with which slide member 42 presses against flow plate 21. If the area of boss 43, exposed within bore 41, is brought close to the area of cavity 45, exposed to low pressure in outlet port 16, the force with which slide member 42 presses against the flow plate is greatly reduced thereby reducing the frictional force, and wear, between the slide member and flow plate. Naturally, the area of boss 43 should not be enlarged to equal the area of cavity 45, otherwise there will be no net force urging these two parts together, and fluid leakage between them will result.

Figure 5:
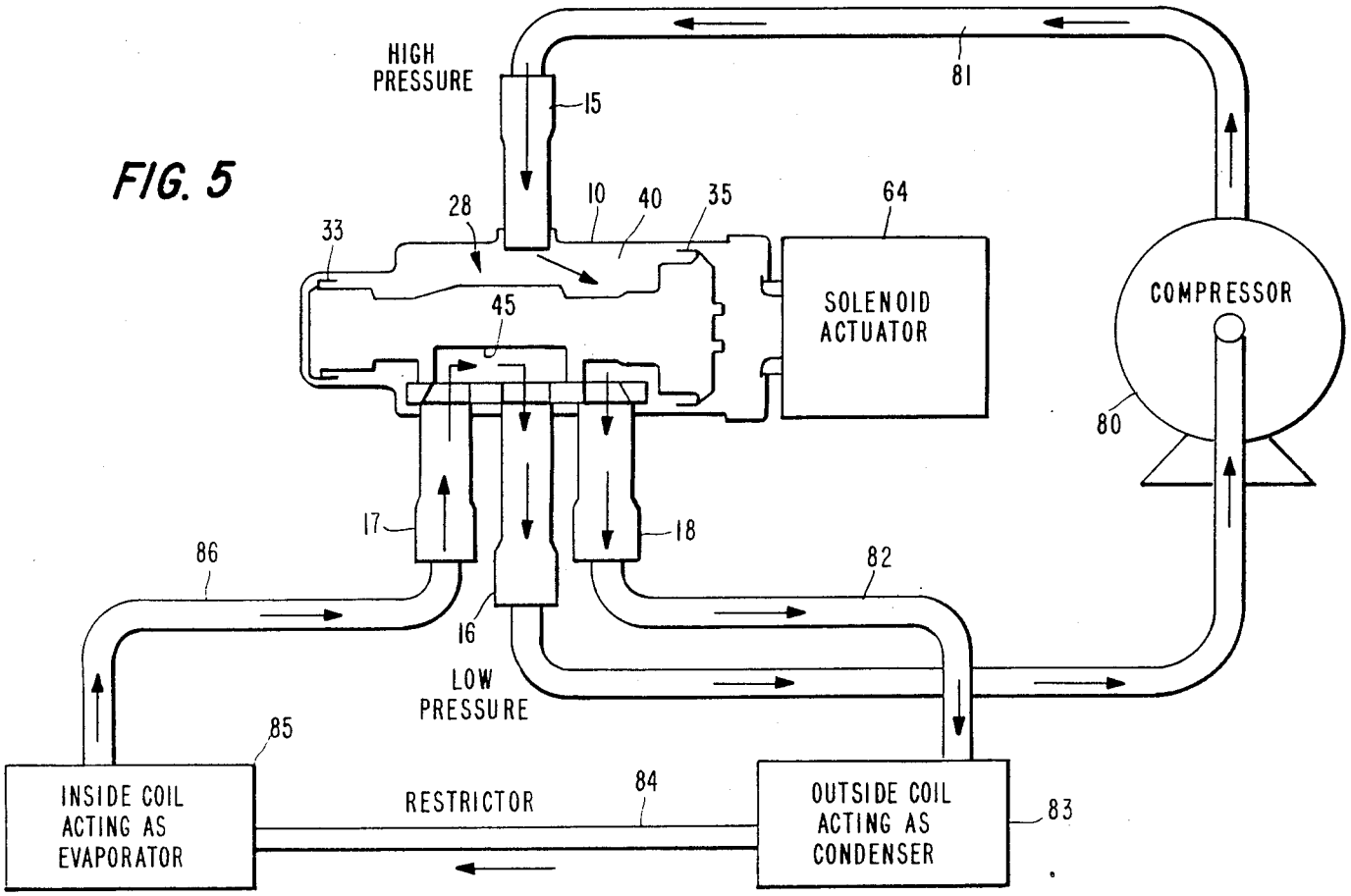
FIG. 5 is a schematic illustration of the slide valve in a heat pump system, wherein the heat pump is serving a cooling function.
Figure 6:
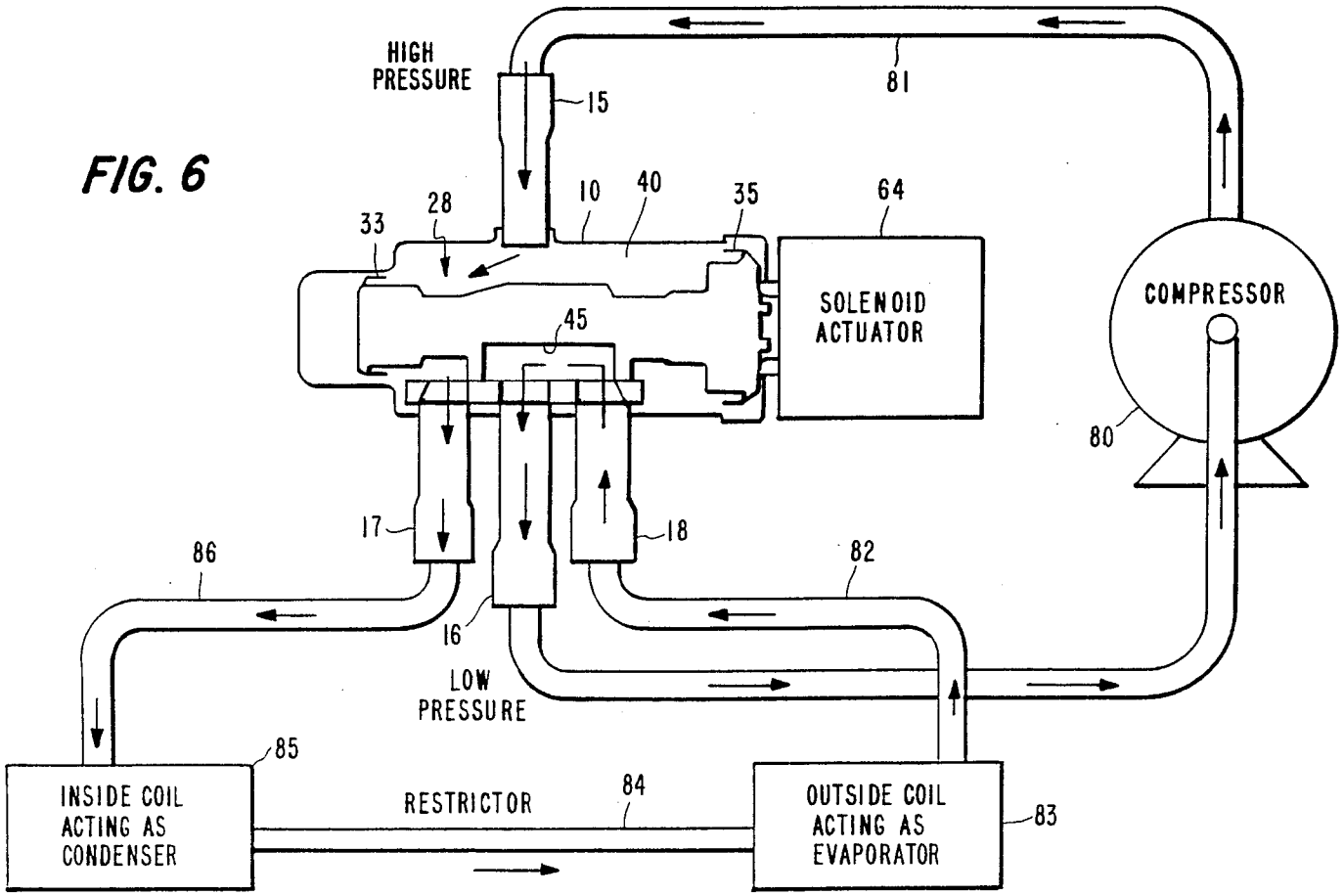
FIG. 6 is a view similar to FIG. 5 wherein the heat pump system is serving a heating function.

One type of installation in which the invention finds utility is as a reversing valve in a heat pump system, illustrated schematically in FIGS. 5 and 6, wherein a suitable refrigerant is the fluid circulated through the system. FIG. 5 shows the heat pump serving to cool an interior space. The high pressure outlet from compressor 80 is connected by a conduit 81 to the inlet port 15 of slide valve body 10. Since slide assembly 28 is in its leftwardmost extreme position, as viewed in FIGS. 3 and 5, the high pressure refrigerant gas in chamber 40 flows through working port 18 and a conduit 82 to the outside coil 83 of the heat pump system, wherein it condenses. From coil 83, the fluid flows through a restrictor 84 to the inside coil 85 of the heat pump system wherein it evaporates and produces a cooling effect. The refrigerant gas then flows through conduit 86 to working port 17, and through cavity 45 and outlet port 16 to the low pressure inlet to compressor 80.

Upon a change of seasons, the valve is operated to position slide assembly 28 in its rightwardmost extreme position, as viewed in FIGS. 1 and 6, so that the heat pump system serves to heat the interior space. In this condition of the slide valve, high pressure gas in chamber 40 flows through working port 17 and conduit 86 to inside coil 85, wherein it condensed and gives off heat. The fluid then flows through restrictor 84 to outside coil 83, wherein it evaporates. From coil 83, the fluid flows through conduit 82, working port 18, cavity 45, and outlet port 16, back to the inlet compressor 80.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A four-way slide valve comprising:

(a) an elongated valve body having an inlet port, an outlet port, and two working ports, (b) a slide assembly within the body movable longitudinally thereof between two extreme positions, one extreme position being closer to one end of the valve body and the other extreme position being closer to the other end of the valve body, the slide assembly including:

I. a slide member for alternatively interconnecting the outlet port with one or the other of the working ports, depending upon which extreme position the slide assembly is in, II. a first piston slidably engaging the valve body and defining a first chamber between itself and one end of the body, and III. a second piston slidably engaging the valve body and defining a second chamber between itself and the other end of the body, (c) passageway means within the slide assembly for providing communication between the first chamber and the outlet port, (d) a pilot valve within the valve body for selectively providing communication alternatively between the second chamber and the inlet port or between the second chamber and the outlet port, so as to cause the slide member to move to one of its extreme positions or the other, and a solenoid actuator, mounted on the valve body, for controlling the condition of the pilot valve, the actuator including an electric coil, an armature movable in response to energization and deenergization of the coil, and means extending into the valve body for transmitting movement of the armature to the pilot valve, the pilot valve including a high pressure orifice through which the second chamber communicates with the inlet port, a low pressure orifice through which the second chamber communicates with the outlet port, and a valve member movable in response to movement of the armature between a position in which it closes the high pressure orifice and opens the low pressure orifice and a position in which it opens the high pressure orifice and closes the low pressure orifice.

2. A four-way slide valve as defined in claim 1 wherein the first piston has a smaller diameter than the second piston, and the portion of the valve body within which the first piston slides has a smaller diameter than the portion of the valve body within which the second piston slides.

3. A four-way slide valve as defined in claim 2 wherein the area of the first piston exposed to the first chamber is about one-half the area of the second piston exposed to the second chamber.

4. A four-way slide valve as defined in claim 2 wherein the passageway means provides constant communication between the first chamber and the outlet port.

5. A four-way slide valve as defined in claim 4 wherein the region within the valve body between the two pistons is in constant communication with the inlet port, so that when the pilot valve causes the second chamber to communicate with the outlet port, the slide assembly is moved by the fluid pressure within the valve body in the direction of the second piston.

6. A four-way slide valve as defined in claim 1 wherein the pilot valve is carried by the slide assembly.

7. A four-way slide valve as defined in claim 6 including passageway means within the slide assembly for providing communication between the pilot valve and the inlet port and between the pilot valve and the outlet port.

8. A four-way slide valve as defined in claim 1 wherein the armature is movable in two opposite directions parallel to the longitudinal direction of the valve body, movement of the armature in one direction causing the valve member to open the high pressure orifice so that the second chamber fills with high pressure fluid from the inlet port in response to which the slide member moves in a direction opposite to the direction in which the armature moved.

9. A four-way slide valve as defined in claim 8 wherein the armature moves in said one direction in response to energization of the solenoid coil.

10. A four-way slide valve as defined in claim 8 wherein movement of the armature in the other direction causes the valve member to open the low pressure orifice so that the second chamber is depressurized in response to which the slide member moves in a direction opposite to the other direction of movement of the armature.

11. A four-way slide valve as defined in claim 10 including a spring for moving the armature in said other direction.

12. A four-way slide valve comprising:

an elongated valve body having an inlet port, the valve body having a flow plate formed with an outlet port and two working ports, a slide assembly within the body movable longitudinally thereof between two extreme positions, a slide member movable with the slide assembly, the slide member having a sliding face slidably engaging the flow plate, a cavity in the slide member extending to the sliding face, the cavity providing communication between the outlet port and one of the working ports when the slide assembly is in one of its extreme positions, and the cavity providing communication between the outlet port and the other of the working ports when the slide assembly is in its other extreme position, the slide member having a face opposite the sliding face and external to the cavity, and means entirely within the valve body for providing direct communication between the opposite face and the outlet port.

13. A four-way slide valve as defined in claim 12 wherein the slide member is movable with respect to the slide assembly in a direction toward and away from the flow plate.

14. A four-way slide valve as defined in claim 12 wherein the communication-providing means is a passageway extending from said opposite face, through the slide member, to the cavity.

15. A four-way slide valve comprising:

an elongated valve body having an inlet port, the valve body having a flow plate formed with an outlet port and two working ports, a slide assembly within the body movable longitudinally thereof between two extreme positions, a slide member movable with the slide assembly, the slide member having a sliding face slidably engaging the flow plate, a cavity in the slide member extending to the sliding face, the cavity providing communication between the outlet port and one of the working ports when the slide assembly is in one of its extreme positions, and the cavity providing communication between the outlet port and the other of the working ports when the slide assembly is in its other extreme position, the slide member having a face opposite the sliding face and external to the cavity, the slide member being movable with respect to the slide assembly in a direction toward and away from the flow plate, and means for providing communication between the opposite face and the outlet port.

16. A four-way slide valve as defined in claim 15 including a guideway carried by the slide assembly, and a follower movable within the guideway in a direction toward and away from the flow plate.

17. A four-way slide valve as defined in claim 16 wherein the guideway is a bore in the slide assembly and the follower is a boss projecting from the slide member.

* * * * *